US008381365B2

(12) United States Patent
Elia et al.

(10) Patent No.: US 8,381,365 B2
(45) Date of Patent: Feb. 26, 2013

(54) STRAP BUCKLE AND METHOD OF SECURING A STRAP PORTION

(76) Inventors: Gerardo P. Elia, Apple Hill (CA); Gary E. Galliers, Canton, MI (US); Audrey Karass, Montreal (CA)

( * ) Notice: Subject to any disclaimer, the term of this patent is extended or adjusted under 35 U.S.C. 154(b) by 198 days.

(21) Appl. No.: 12/957,765

(22) Filed: Dec. 1, 2010

(65) Prior Publication Data

US 2011/0209312 A1 Sep. 1, 2011

Related U.S. Application Data

(60) Provisional application No. 61/308,573, filed on Feb. 26, 2010.

(51) Int. Cl.
*A44B 11/02* (2006.01)

(52) U.S. Cl. ..... 24/169; 24/200

(58) Field of Classification Search ..... 24/169, 24/197, 198, 200, 23 W, 23 B, 171, 196
See application file for complete search history.

(56) References Cited

U.S. PATENT DOCUMENTS

| | | | | |
|---|---|---|---|---|
| 1,519,708 | A | 12/1924 | Tapp et al. | |
| 2,542,044 | A | 2/1951 | Miller et al. | |
| 2,924,865 | A | 2/1960 | Berning | |
| 3,177,541 | A * | 4/1965 | Derrickson | 24/200 |
| 3,206,816 | A | 9/1965 | Vilcins et al. | |
| 3,213,503 | A | 10/1965 | Carter et al. | |
| 3,271,831 | A * | 9/1966 | Litwin | 24/200 |
| 3,336,639 | A * | 8/1967 | Rutty et al. | 24/200 |
| 3,414,943 | A | 12/1968 | Hattori | |
| 3,896,525 | A | 7/1975 | Stewart, Jr. et al. | |
| 3,969,792 | A | 7/1976 | Hattori | |
| 4,117,573 | A | 10/1978 | Nakamura | |
| 4,392,277 | A | 7/1983 | Müller | |
| 4,398,321 | A | 8/1983 | Sunesson | |
| 4,400,855 | A | 8/1983 | Stuart | |
| 4,699,747 | A | 10/1987 | Lovato | |
| 5,144,724 | A | 9/1992 | Chuan | |
| 5,600,875 | A | 2/1997 | Chang | |
| 5,644,822 | A | 7/1997 | Frew | |
| 6,412,150 | B1 | 7/2002 | Monderine | |
| 6,553,632 | B1 | 4/2003 | Brumpton | |
| 7,404,753 | B2 | 7/2008 | Cheng | |

FOREIGN PATENT DOCUMENTS

| | | |
|---|---|---|
| CN | 2156146 Y | 2/1994 |
| FR | 1602642 | 1/1971 |
| FR | 2182300 | 11/1973 |
| GB | 324786 | 2/1930 |
| WO | 9851583 | 11/1998 |

* cited by examiner

*Primary Examiner* — James Brittain
(74) *Attorney, Agent, or Firm* — IPAXIO S.E.N.C.

(57) ABSTRACT

The buckle includes a first and a second clamp member positioned substantially parallel to one another. End members are provided at the opposite ends of the first clamp member. The buckle includes a set of pliable wall directly interconnecting one of the end members to the second clamp member. The pliable walls are subjected to a permanent plastic deformation when the second clamp member is moved closer to the first clamp member.

18 Claims, 5 Drawing Sheets

STRAP BUCKLE AND METHOD OF SECURING A STRAP PORTION

CROSS REFERENCE

The present case claims priority over U.S. provisional patent application No. 61/308,573 filed Feb. 26, 2010, the content of which is hereby incorporated by reference in its entirety.

TECHNICAL FIELD

The technical field relates generally to buckles, and more particularly to buckles to which one or more strap portions can be secured.

BACKGROUND

Over the years, numerous different kinds of buckles have been suggested. Some of these buckles were developed for specific applications while others were more universal in nature. Buckles are constructed so that a portion of at least one strap, or another similar item, can be secured to the buckle. Some buckles can also receive a portion of another strap or a second portion of the same strap to secure them all together. Other arrangements exist as well.

While most existing buckles can be found satisfactory to a certain degree, there is a constant need for improvements, for example in terms of simplicity, efficiency, ease of use and manufacturing costs. Accordingly, room for improvements always exists in this area.

SUMMARY

In one aspect, there is provided a strap buckle including: a first and a second clamp member positioned substantially parallel to one another, each clamp member having an elongated body extending between two opposite ends; a first and a second end member, each connected to a corresponding one of the ends of the first clamp member, the first and the second end member each including a side seat formed therein and that is in coinciding alignment with a corresponding body portion of the second clamp member; and a set of pliable walls directly interconnecting the side seat of the first end member with its coinciding body portion of the second clamp member, the side seat of the second end member and its coinciding body portion of the second clamp member being unconnected directly to one another, the pliable walls being subjected to a permanent plastic deformation when the second clamp member is moved from an initial first position, where the first and the second clamp member are laterally spaced apart from one another and where the body portions of the second clamp member are laterally spaced apart from their coinciding side seats, towards a second position where the first and the second clamp member are in close juxtaposition to one another and where the body portions of the second member are close juxtaposition to their coinciding side seats.

In another aspect, there is provided a single-use buckle to be attached to at least one strap portion, the buckle including: a double-sided center frame section having two spaced-apart and mutually parallel first clamp members, the first clamp members being connected together at opposite ends by two end members; two sets of pliable walls; and two second clamp members, one for each side of the center frame section, the second clamp members being parallel to and initially spaced-apart from a corresponding one of the first clamp members, each second clamp member being connected to only one of the end members using a corresponding one of the sets of pliable walls.

In another aspect, there is provided a method of securing a strap portion using a buckle, the method including: inserting a loop of the strap portion over one of two mutually parallel and initially spaced-apart clamp members of the buckle; moving the clamp member with the loop closer to the other clamp member by force; while the clamp member is moved closer to the other, causing a permanent plastic deformation of a connector attaching the two clamp members together; and releasing the force once the loop is in a full retaining engagement between the two clamp members, the permanently deformed connector maintaining at least in part the full retaining engagement after releasing the force.

Further details on these aspects as well as other aspects of the proposed concept will be apparent from the following detailed description and the appended figures.

DETAILED DESCRIPTION

Figure 1:
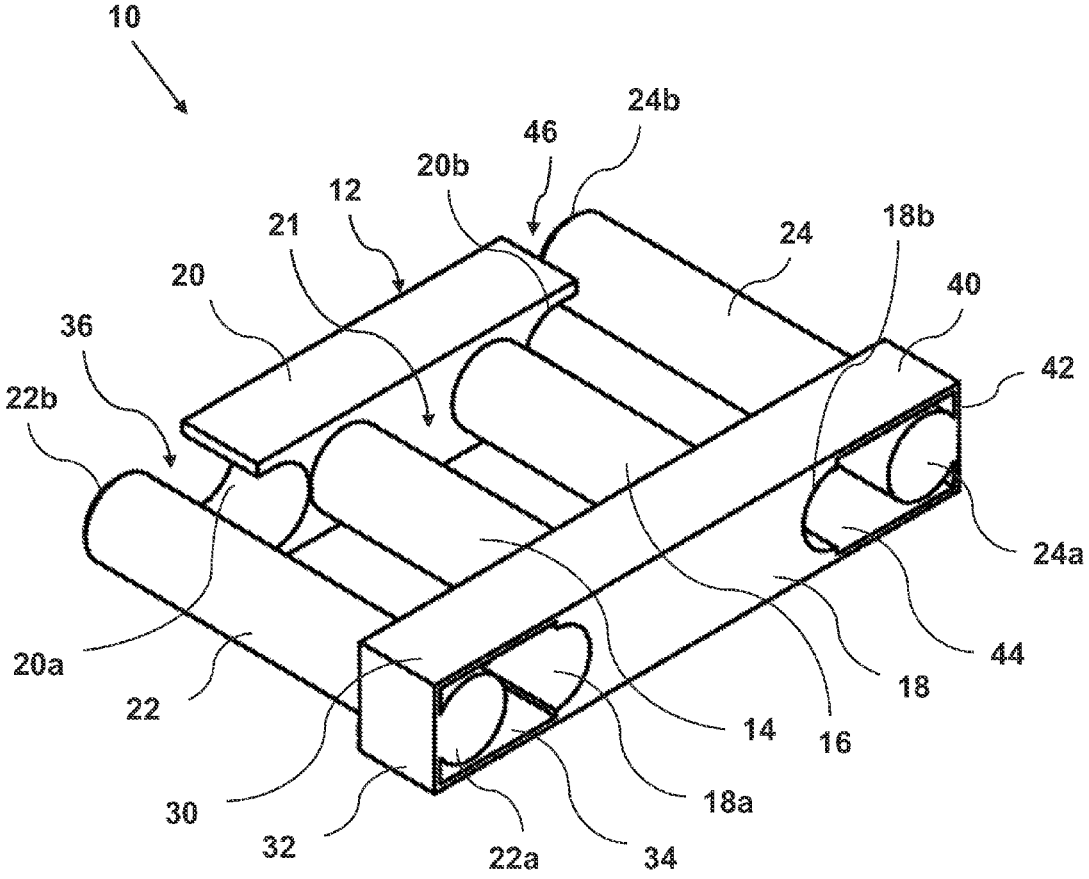
FIG. 1 is an isometric view illustrating an example of a strap buckle as suggested herein.
Figure 2:
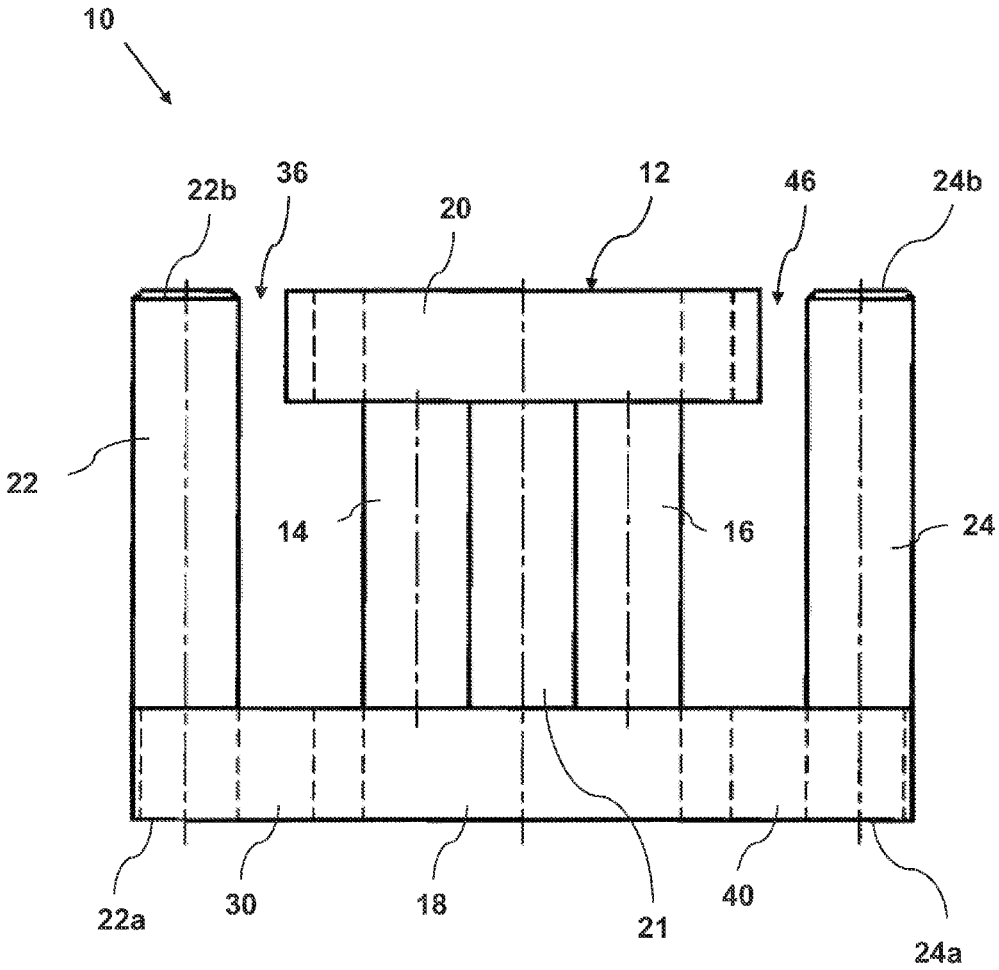
FIG. 2 is a top plan view of the buckle shown in FIG. 1.
Figure 3:
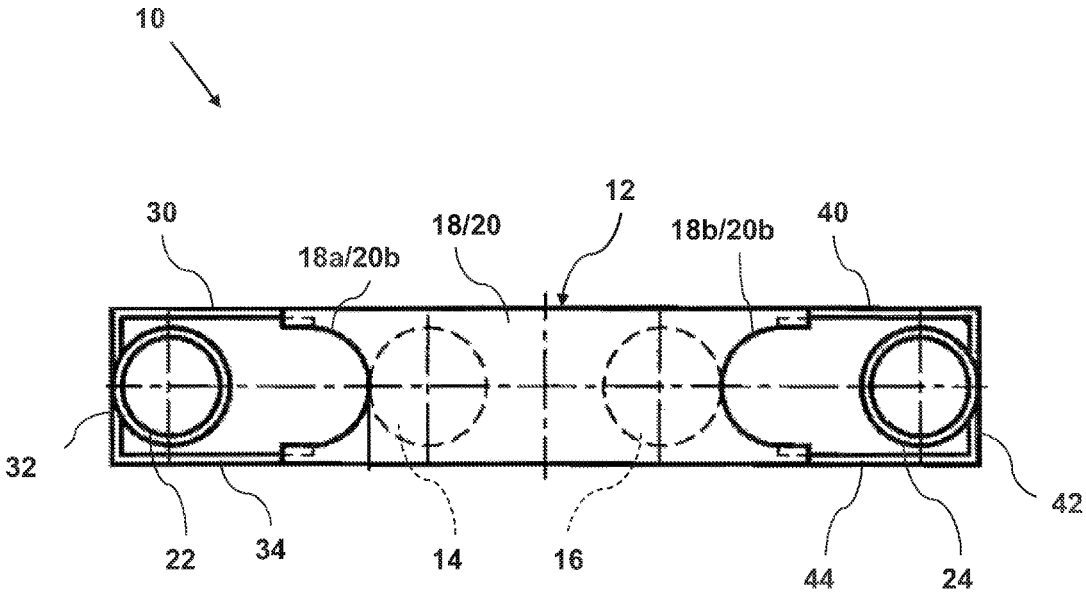
FIG. 3 is a side elevational view of the buckle shown in FIG. 1.

FIG. 1 is an isometric view illustrating an example of a strap buckle 10 as suggested herein, FIG. 2 is a top plan view of the buckle 10 shown in FIG. 1. FIG. 3 is a side elevational view thereof. This buckle 10 is only one example among a multitude of possible arrangements and configurations. For instance, although the illustrated buckle 10 has a double-sided configuration, the buckle 10 can also be constructed with a single-sided configuration.

The various parts of the buckle 10 can be manufactured as a monolithic structure. The buckle 10 can be made of a plastic material, for instance polypropylene. It can be mass produced at a very low cost, for instance by injection molding. Other materials and manufacturing methods are also possible as well.

As shown in FIGS. 1 to 3, the illustrated buckle 10 includes a center frame section 12. The center frame section 12 includes two spaced-apart and mutually parallel first clamp members 14, 16. The first clamp members 14, 16 have a substantially cylindrical and elongated body in the illustrated example. Other shapes are also possible. The first clamp members 14, 16 are rigidly connected together at their opposite ends by a first and a second end member 18, 20 that are also part of the center frame section 12. The two end members 18, 20 are parallel to one another. They have a square-shaped cross section in the illustrated example but other shapes are also possible. An open intervening space 21 is defined between the two first clamp members 14, 16.

The buckle 10 also includes two second clamp members 22, 24 that are provided on each side of the center frame section 112. These second clamp members 22, 24 have a substantially cylindrical and elongated body in the illustrated example but other shapes are also possible. The second clamp members 22, 24 are disposed parallel to the first clamp members 14, 16 and all first and second clamp members 14, 16, 22, 24 are substantially coplanar in the illustrated example. Variants are possible.

Each second member 22, 24 is initially spaced-apart from its corresponding adjacent first clamp member 14, 16. Each second clamp member 22, 24 has a body portion near one of its opposite ends that is connected to the center frame section 12 using a corresponding set of relatively thin and pliable walls. In the illustrated example, the body portion of the second clamp member 22 near its end 22*a* is interconnected with the first end member 18 by three pliable walls 30, 32, 34. Likewise, the body portion of the second clamp member 24 near its end 24*a* is interconnected with the first end member 18 by three pliable walls 40, 42, 44. Each set of pliable walls includes two spaced-apart and longitudinally-extending walls 30, 34, 40, 44 projecting from a corresponding one of the sides of the first end member 18. These walls 30, 34, 40, 44 join a corresponding perpendicular wall 32, 42 to which one of the second clamp members 22, 24 is connected. The walls 32, 42 are made integral with a location on the corresponding body portion of the second members 22, 24 that is diametrically opposite the first end member 18.

Each of the second clamp members 22, 24 has an opposite free end 22*b*, 24*b*. There are thus open intervening spaces 36, 46 between the body portion of the second clamp members 22, 24 near these free ends 22*b*, 24*b* and the sides of the second end member 20. These open intervening spaces 36, 46 allow inserting a pre-formed loop around any one of the second clamp members 22, 24.

The first and the second end member 18, 20 each includes a pair of opposite semi-circular side seats 18*a*, 18*b*, 20*a*, 20*b* whose diameter substantially corresponds to that of the second clamp members 22, 24. These side seats 18*a*, 18*b*, 20*a*, 20*b* are in coinciding alignment with a corresponding body portion near the ends 22*a*, 22*b*, 24*a* 24*b* of the second clamp members 22, 24.

As can be seen from FIGS. 1 to 3, the illustrated buckle 10 is symmetrical with reference to a first plane of symmetry extending across the intervening space 21 between the two first clamp members 16, 18. The illustrated buckle 10 is also symmetrical with reference to a second plane of symmetry that is orthogonal to the first plane of symmetry and that is coextensive with longitudinal axes of the two first clamp members 16, 18. Variants are possible as well.

In use, the walls 30, 32, 34 are subject to a permanent plastic deformation when a force is applied for moving the second clamp member 22 towards the first clamp member 14. Likewise, the walls 40, 42, 44 are subject to a permanent plastic deformation when a force is applied for moving the other second clamp member 24 towards the other first clamp member 16. The walls 30, 32, 34, 40, 42, 44 are designed to maintain their integrity during that movement. Thus, they always remain attached to the second clamp members 22, 24 and to the first end member 18.

The buckle 10 is constructed so that on one side, the second clamp member 22 can be moved from an initial first position, where the second clamp members 22 and its adjacent first clamp member 14 are laterally spaced apart from one another and where the body portions of the second clamp member 22 are laterally spaced apart from their corresponding side seats 18*a*, 20*a*, towards a second position where these first and second clamp members 14, 22 are in close juxtaposition to one another and where the body portions of the second clamp member 22 are close juxtaposition to their corresponding side seat 18*a*, 20*a*. Likewise, on the other side of the buckle 10, the second clamp member 24 can be moved from an initial first position, where the second clamp members 24 and its corresponding first clamp member 16 are laterally spaced apart from one another and where the body portions of the second clamp member 24 are laterally spaced apart from their corresponding side seats 18*b*, 20*a*, towards a second position where these first and second clamp members 16, 24 are in close juxtaposition to one another and where the body portions of the second clamp member 24 are close juxtaposition to their corresponding side seat 18*b*.

In the illustrated example, the bottom location of the semi-circular concave openings of each side seat 18*a*, 18*b*, 20*a*, 20*b* is in registry with the outer surface of the corresponding first clamp members 14, 16. This way, when using tubular-shaped second clamp members 22, 24 as shown, the body of the second clamp members 22, 24 can laterally engage the body of the corresponding first clamp members 14, 16 when the body portions of the second clamp members 22, 24 laterally engage the bottom of the corresponding side seats 18*a*, 18*b*, 20*a*, 20*b*. Other configurations and arrangements are also possible. For instance, the second clamp members 22, 24 can laterally engage their corresponding side seats 18*a*, 18*b*, 20*a*, 20*b* without having the bodies of the first clamp members 14, 16 and of the second clamp members 22, 24 laterally engaging one another on each side. This configuration could be used when the thickness of the strap portion is always greater than the remaining space between the first and second clamp members 14, 16, 22, 24 when the second clamp members 22, 24 are at their second position. Other examples are possible.

The illustrated buckle 10 can be used for securing one or more strap portions. When multiple strap portions are used, the strap portions can be, for instance, portions from the opposite ends of a same strap or portions from two different straps. Many different arrangements and configurations are possible.

Figure 4:
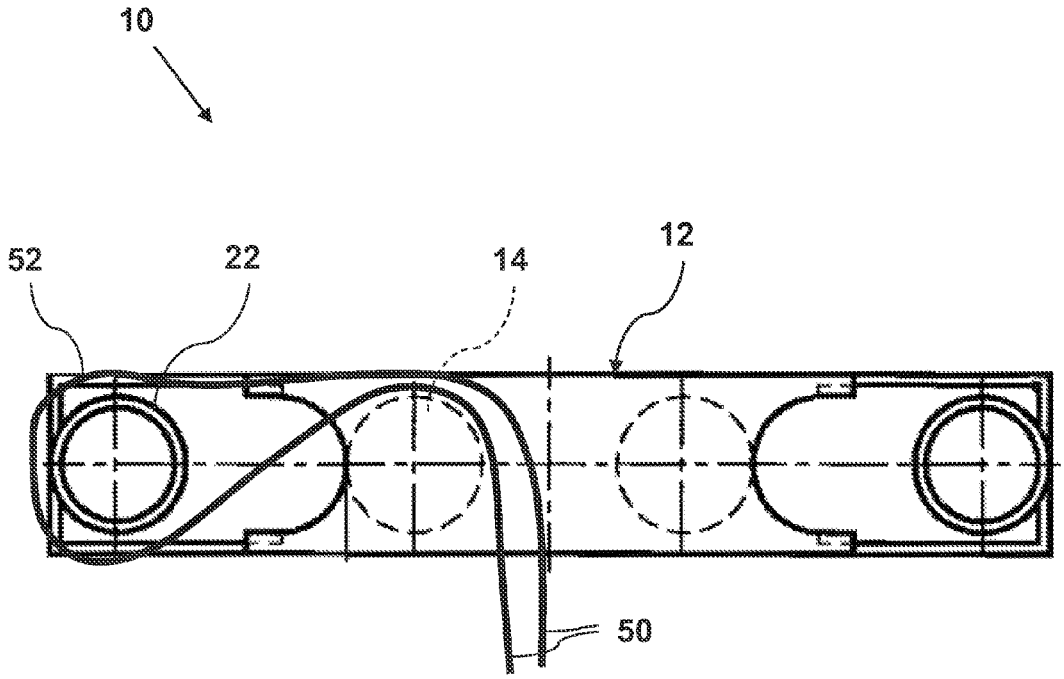
FIGS. 4 and 5 are views similar to FIG. 3 and illustrate an example of a method of securing a strap portion as suggested herein.
Figure 5:
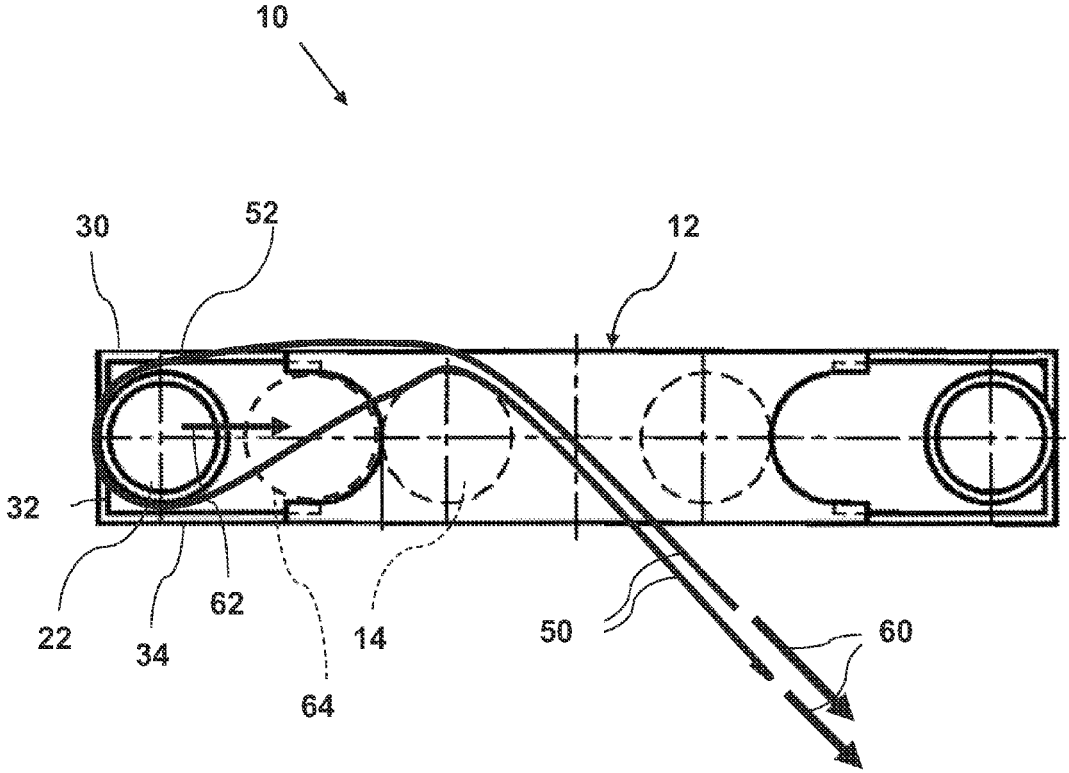

FIGS. 4 and 5 are views similar to FIG. 3 and illustrate an example of a method of securing a strap portion 50 as suggested herein. The strap portion 50 passes through the center frame section 12 and then around the second clamp member 22 at the left. A loop 52 was made with the strap portion 50 to be secured into the buckle 10. The loop 52 was inserted through the open intervening space 21 between the two first clamp members 14, 16 and then around the second clamp member 22 at the left using the open intervening space 36 (FIG. 2). Thereafter, the loop 52 was positioned so as to extend substantially longitudinally in the buckle 10. It should be noted that for ease of illustration, the strap portion 50 and the loop 52 in FIGS. 4 and 5 are visible as if the buckle 10 would be transparent.

Pulling on the strap portion 50 with enough force moves the second clamp member 22 along a substantially linear path from its initial position towards the second position where the body portions near its ends 22*a*, 22*b* abut on the corresponding side seats 18*a*, 20*a* of the two end members 18, 20. The side seats 18*a*, 20*a* help keeping the path of the second clamp member 22 substantially linear near the second position. The walls 30, 32, 34 holding the second clamp member 22 to the first end member 18 will be permanently deformed in the process. This will help prevent the second clamp member 22 from moving back towards its initial position in addition to the remaining tension in the strap portion 50. The remaining tension in the strap portion 52 also maintains the force squeezing it firmly between the body of the first clamp member 14 and the body of the second clamp member 22. The laterally-extending pa is of the side seats 18*a*, 20*a* prevent the second clamp member 22 from moving perpendicularly with reference to the first clamp member 14.

FIG. 5 illustrates an example of the loop 52 as the strap portion 50 is pulled, for instance by hand, in direction of the arrows 60 to move the second clamp member 22 in direction of arrow 62. The stippled line 64 shows the approximate final position of the second clamp member 22 once the strap portion is in a full retaining engagement between the first clamp member 14 and the second clamp member 22.

When the buckle 10 has a double-sided construction, as illustrated, a second loop (not shown) can be made with another strap portion and this second loop can be secured into the buckle 10 as well. The second loop is inserted through the open intervening space 21 between the two first clamp members 14, 16 and then around the second clamp member 24 using the open intervening space 46 (FIG. 2). Pulling on the other strap portion will force the second clamp member 24 to move towards the center frame section 12 along a substantially linear path until its opposite portion abut on the corresponding side seats 18*b*, 20*b* of the end members 18, 20.

The buckle 10 is for a one-time use only since the pliable walls 30, 32, 34, 40, 42, 44 are subjected to a permanent plastic deformation when the buckle 10 is closed on both sides. However, opening the buckle 10 is possible by releasing the tension in the strap portions 50 and by pushing back the second clamp members 22, 24, for instance using a tool such as the tip of a screwdriver or the like, to counteract the resistance from the deformed walls. The buckle 10 can be discarded afterwards or sent to a material recycling facility. The buckle 10 can also be removed from an item by simply cutting the straps.

The buckle 10 can be used with a wide variety of straps and in a wide variety of environments. For instance, the buckle 10 can be useful with packaging straps or other kinds of straps that are designed to be discarded after one use. Many other applications are possible as well.

The present detailed description and the appended figures are meant to be exemplary only, and a skilled person will recognize that variants can be made in light of a review of the present disclosure without departing from the proposed concept. For instance, the buckle can be single sided. The buckle does not need to have a symmetrical construction. The first clamp members, the two end members and the second clamp members can have different shapes than the ones shown and described herein. The words "strap", "straps" and other similar words are used in a generic manner to designate an elongated and substantially flat flexible element with which the buckle can be used. The buckle can be made of a non-plastic material, one example a metal. The expression "plastic deformation" or the like can also apply to non-plastic materials since it refers to the deformation or change in shape of a solid body without fracture under the action of a sustained force. The expression thus not directly relates to the kind of material being used. The first clamp members and the second clamp members do not necessarily need to be identical in shape and size.

What is claimed is:

1. A strap buckle including:

a first and a second clamp member positioned substantially parallel to one another, each clamp member having an elongated body extending between two opposite ends;

a first and a second end member, each connected to a corresponding one of the ends of the first clamp member, the first and the second end member each including a side seat formed therein and that is in coinciding alignment with a corresponding body portion of the second clamp member; and a set of pliable walls directly interconnecting the side seat of the first end member with its coinciding body portion of the second clamp member, the side seat of the second end member and its coinciding body portion of the second clamp member being unconnected directly to one another, the pliable walls being subjected to a permanent plastic deformation when the second clamp member is moved from an initial first position, where the first and the second clamp member are laterally spaced apart from one another and where the body portions of the second clamp member are laterally spaced apart from their coinciding side seats, towards a second position where the first and the second clamp member are in close juxtaposition to one another and where the body portions of the second member are close juxtaposition to their coinciding side seats.

2. The buckle as defined in claim 1, wherein the body of the first clamp member is substantially tubular in shape.

3. The buckle as defined in claim 2, wherein the body of the second clamp member is substantially tubular in shape.

4. The buckle as defined in claim 3, wherein the side seats of the first and the second end member are substantially semi-circular in shape, each side seat having an inner surface matching an outer surface of its corresponding body portion of the second clamp member.

5. The buckle as defined in claim 4, wherein the inner surface of each side seat has a bottom location that is substantially in registry with an outer surface on the body of the first clamp member.

6. The buckle as defined in claim 1, wherein the set of pliable walls includes two walls projecting from and made integral with lateral parts of the side seat of the first end member.

7. The buckle as defined in claim 6, wherein each pliable wall has a width substantially identical to a width of the first end member.

8. The buckle as defined in claim 6, wherein each of the two pliable walls is made integral with a third pliable wall, the third pliable wall being substantially orthogonal with reference to the other two pliable walls and being made integral with a location on the corresponding body portion of the second clamp member that is diametrically opposite the first end member.

9. The buckle as defined in claim 1, wherein the buckle is double sided and each side includes the first clamp member and the second clamp member, both sides sharing the same first and second end members, the first clamp members being spaced apart and parallel to one another.

10. The buckle as defined in claim 9, wherein the double-sided buckle is symmetrical with reference to a first plane of symmetry extending across an intervening space between the two first clamp members.

11. The buckle as defined in claim 10, wherein the double-sided buckle is also symmetrical with reference to a second plane of symmetry that is orthogonal to the first plane of symmetry and that is coextensive with longitudinal axes of the two first clamp members.

12. The buckle as defined in claim 1, wherein the first clamp member, the second clamp member, the first end member, the second end member and the pliable walls form a monolithic structure.

13. The buckle as defined in claim 12, wherein the buckle is made of a plastic material.

14. A single-use buckle to be attached to at least one strap portion, the buckle including:

a double-sided center frame section having two spaced-apart and mutually parallel first clamp members, the first clamp members being connected together at opposite ends by two end members;

two sets of pliable walls; and two second clamp members, one for each side of the center frame section, the second clamp members being parallel to and initially spaced-apart from a corresponding one of the first clamp members, each second clamp member being connected to only one of the end members using a corresponding one of the sets of pliable walls.

15. The buckle as defined in claim 14, wherein each set of pliable walls are subjected to a permanent plastic deformation while maintaining integrity when a corresponding one of the second clamp members is moved closer to one of the first clamp members.

16. The buckle as defined in claim 14, wherein the buckle has a monolithic structure.

17. The buckle as defined in claim 16, wherein the buckle is made of a plastic material.

18. A method of securing a strap portion using a buckle, the method including:

inserting a loop of the strap portion over one of two mutually parallel and initially spaced-apart clamp members of the buckle;

moving the clamp member with the loop closer to one the other clamp member by force;

while the clamp member is moved closer to the other, causing a permanent plastic deformation of a connector attaching the two clamp members together; and releasing the force once the loop is in a full retaining engagement between the two clamp members, the permanently deformed connector maintaining at least in part the full retaining engagement after releasing the force.

* * * * *